United States Patent [19]

Goott

[11] 4,364,567

[45] Dec. 21, 1982

[54] POKER-KENO GAME

[75] Inventor: Joseph Goott, Great Falls, Mont.

[73] Assignee: Tropic Industries, Inc., Great Falls, Mont.

[21] Appl. No.: 43,678

[22] Filed: May 30, 1979

Related U.S. Application Data

[63] Continuation-in-part of Ser. No. 15,151, Feb. 26, 1979, abandoned, which is a continuation of Ser. No. 808,954, Jun. 22, 1977, abandoned.

[51] Int. Cl.[3] ..... A63F 5/00; A63B 71/00

[52] U.S. Cl. ..... 273/237; 273/144 B; 273/274

[58] Field of Search ..... 273/138 R, 138 A, 139, 273/144 R, 144 A, 144 B, 148 R, 149 R, 149 P, 274, 237; D21/25, 26

[56] References Cited

U.S. PATENT DOCUMENTS

| | | | |
|---|---|---|---|
| Des. 139,194 | 10/1944 | Paul | D21/26 |
| Des. 183,007 | 6/1958 | Lord | D21/26 |
| 1,723,377 | 8/1929 | Salomon | 273/274 X |
| 2,383,860 | 8/1945 | Hickey | 273/148 R |
| 3,786,234 | 1/1974 | Trent et al. | 273/138 A X |
| 3,998,462 | 12/1976 | Goott | 273/138 R |
| 4,033,588 | 7/1977 | Watts | 273/138 A |

FOREIGN PATENT DOCUMENTS

| | | | |
|---|---|---|---|
| 1348632 | 3/1974 | United Kingdom | 273/274 |

OTHER PUBLICATIONS

Scarne's Complete Guide to Gambling, by John Searne, Simon and Schuster, N.Y., 1961, Race-Horse Keno, pp. 432-436.

*Primary Examiner*—Richard C. Pinkham
*Assistant Examiner*—Arnold W. Kramer
*Attorney, Agent, or Firm*—Antonelli, Terry & Wands

[57] ABSTRACT

A poker-Keno-type game which can be played by one or more persons. The game comprises a Keno-like "goose" containing fifty-two balls each bearing the representation of a card in a conventional deck of playing cards. After the balls are mixed or shuffled in the "goose" to assure randomness, a number of balls, corresponding to the number of cards dealt in a poker hand (e.g. five cards), are blown into "rabbit ears" in consecutive order. The results of the poker hand are displayed on at least one game board either in the form of a large board which can be hung so as to be seen in a large room or in the form of a table game. Prior to the initiation of the game, each player uses a slip, if the large board is used, or chips or the like, if a table game is used, in attempting to guess, for example, if one or more of the cards has a value of "9" or better with Aces being high, or a value of "2" through "7" being low. Each player can also use the slip or chips to guess if the hand contains conventional poker combinations such as a straight, a flush, a full house or the like.

30 Claims, 5 Drawing Figures

POKER-KENO GAME

This application is a continuation-in-part of my application Ser. No. 15,151, filed Feb. 26, 1979, now abandoned which, in turn, was a continuation of my application Ser. No. 808,954, filed June 22, 1977, and now abandoned.

The present invention is directed to a game using a novel combination of a Kento-type game and a form of game described in my U.S. Pat. No. 3,998,462, issued Dec. 21, 1976, which is played basically upon probabilities and, more particularly, a game of chance which utilizes the elements of Keno and poker and which can be played by one or more players or, for that matter, very many players at the same time.

The game of the present invention can be played by persons having detailed knowledge of poker but, at the same time, is enjoyable and readily understood by those who enjoy Keno as well as those who are only vaguely or not at all familiar with the game of poker. Even those who are not familiar with poker or Keno are able to play the game of the present invention intelligently because the odds of guessing successfully are printed on both the game board, as well as upon slips given to each player for each game. Moreover, players can make inconsistent plays, if they so desire, by virtue of the arrangement of the game surface and the manner in which the game is played.

The foregoing objects have been achieved in accordance with the present invention by providing a Keno-type apparatus and a game board which can either be hung in a room or a game table. As is well known in the game of Keno, twenty winning numbers are selected at random from a clear plastic bowl or a metal cage called a "goose" which contains eighty balls that are numbered from 1 through 80. All of the balls are mixed by an air current and 20 balls are blown one at a time into two "rabbit ears." Such machines are conventional and are manufactured, for example, by Tripp Plastics, in Reno, Nev. Other variations of this arrangement exist, but the foregoing is illustrative of the type of arrangement which is generally used. After the twenty balls are blown into the "rabbit ears," the results are displayed on one or more Keno boards which can be located in places where the selected numbers are prominently displayed on the boards.

With the present invention, instead of numbers 1 through 80 being provided on Keno balls in the "goose," 52 balls are present in the "goose" and each bears a representation of one of 52 cards in a conventional playing deck of cards used in poker. That is, each ball contains the representation of a suit (e.g. Heart) as well as a number of face card (e.g. 2, 3, 4 etc. or Jack. Queen or King). At the beginning of a game, the operator blows at random five balls from the "goose," where the fifty-two balls have been mixed or shuffled, into the "rabbit ears" in the order 1 through 5 to represent a dealer who normally places five cards face down from a deck of cards in dealing a poker hand. According to one embodiment of the present invention, prior to the five balls representing cards of a poker hand being blown into the "rabbit ears," each participant in the game can guess on slips whether each card is a high card (e.g., 9, 10, Jack, Queen, King, Ace) or a low card (2, 3, 4, 5, 6, or 7). If, for example, five balls are blown into the rabbit ears, each participant will have the opportunity of guessing whether one or more of the five "cards" is a high card or a low card. Of course, the participants are not required to make any guesses for this purpose, although it is obviously expected that each participant having a slip will play in some aspect of the game during each "hand" that is dealt by the operator blowing the balls into the "rabbit ears" from the "goose."

Furthermore, prior to the five balls being blown into the "rabbit ears" to represent the number of cards in a poker deal, each game participant will have the opportunity of deciding, for example, by indicating on his or her slip if all of the cards in that hand are all red or all black or if all the cards in the hand are face cards (i.e., Jacks, Queens, and/or Kings). Furthermore, the participants likewise have the option of guessing, based upon the odds printed on the game board, whether the dealt hand will constitute all high cards (e.g., 9, 10, Jack, Queen, King, Ace), a pair of sixes or better, a pat seven or better (i.e., 7 or lower with no pairings), all low cards (e.g. 2, 3, 4, 5, 6, or 7), two pairs, three of a king, a straight, a flush, and/or a full house.

Prior to the beginning of each game, the participants can also mark on their slips their guess for playing "pat hands," The players are informed of the dealer's odds against the chances of a player's being successful based upon the information on the board. According to one preferred embodiment of the present invention, the highest card in such a pat hand can be an "8" card and the remaining cards must be lower and unpaired. A "wheel," i.e., a straight of 5, 4, 3, 2, 1 is considered by the dealer to deserve the highest odds in playing "pat hands."

According to another embodiment of the present invention, the game can be played on a table without the use of slips by using chips or the like directly on the table at the particular spot or spots containing the card values or combinations upon which the player desires to guess for a particular hand.

BRIEF DESCRIPTION OF THE DRAWING

These and further objects and features of the present invention will become more apparent from the following description when taken in conjunction with the following drawing which shows, for purposes of illustration only, several preferred embodiments of the present invention, and more particularly.

DETAILED DESCRIPTION OF TWO PREFERRED EMBODIMENTS

Figure 1:
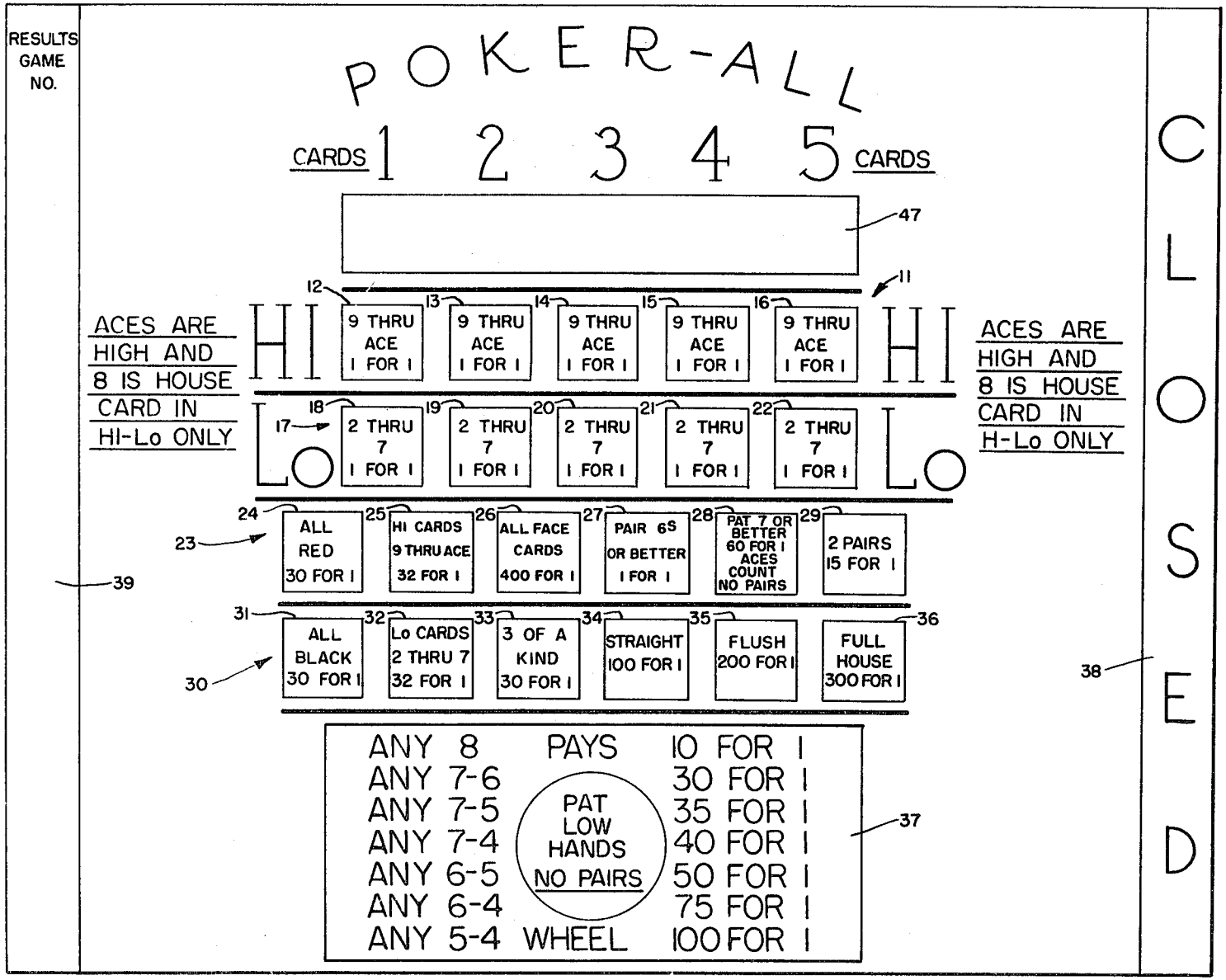
FIG. 1 shows one embodiment of the novel arrangement on the surface of the board upon which the game results are electrically displayed in a conventional manner and which arrangement is also printed on slips used by the game participants.
Figure 2:
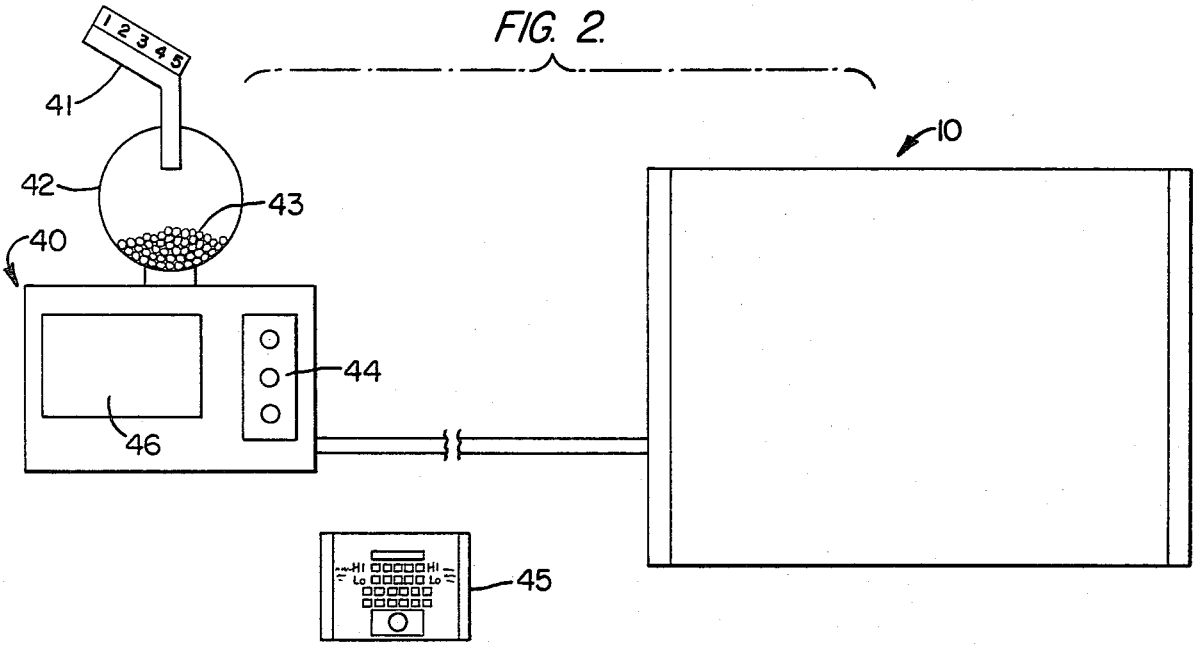
FIG. 2 is a schematic view showing a conventional device for blowing the balls and thus constituting, in effect, a dealing of the cards in conjunction with the game board and the slips used by the participants for indicating their guesses.

Referring now to the drawing and, in particular, to FIG. 1, numeral 10 designates generally a game board which is electrically operated in a conventional manner and which can be large enough, e.g. 3 feet high by about 4 feet wide, to be seen in a large room. The board, also designated by the numeral 10 in FIG. 2, is provided with markings for electrically displaying the results of the balls blown by a Keno-type "goose" schematically shown and designated generally by the numeral 40 in FIG. 2. On the board surface 10, there are five large numbers "1" through "5" to designate each of the five cards of a conventional poker hand which are blown up into "rabbit ears" 41 of the Keno-type goose 40 during the game. The "goose" 42 contains fifty-two balls 43 representing the thirteen cards of each suit (Hearts, Diamonds, Spades, and Clubs) conventionally used in the game of poker. A control panel permits the operator before the beginning of the game to randomly mix or "shuffle" the balls in the goose and then blow or "deal" five balls into the "rabbit ears" 41.

On one side of approximately the center line of the board surface 10 are provided two rows of boxes 11 and 17 with the box in each row aligned under each large number. One row 11 of five boxes (the boxes of which are designated only for the description purposes here by the numerals 12 through 16) is adjacent the word "HI." Similarly, the other row 17 of five boxes (the boxes of which are designated only for description purposes here by numerals 18 through 22) aligned with each large number and with the "HI" boxes is adjacent the word "Lo." The manner and sequence in which the players proceed to utilize these boxes will be described hereinbelow. However, it can be seen that the players have a choice for each card being dealt of calculating the chance of whether such card is a high card (i.e., 9, 10, Jack Queen, King, or Ace), or a low card (i.e., 2, 3, 4, 5, 6, or 7). In any event, the odds given for guessing whether such card is "HI" or "Lo" can also be stated in each of the boxes 12 through 16 and 18 through 22 as being 1 for 1.

On the other side of the imaginary center line of the game board 10 are provided a row 23 of boxes (designated only for purposes of description here by the numerals 24 through 29) where the players can guess the chance of the cards 1 through 5 dealt in a hand being all in red suits and/or high cards (9through Ace) and/or all face cards (Jacks, Queens, Kings), a pair of sixes or better, a pat 7 or better (no card higher than a seven and no pairings), and/or two pairs. Again, the odds on the correctness of any such guess can be stated in each of the appropriate boxes and may vary according to the mathematical probability of achieving such a hand. Likewise, there is also provided a row 30 of boxes (designated only for purposes of description here by the numerals 31 through 36) with a space for each player to guess if the card hand dealt by the Keno-type machine will contain cards all in black suits, and/or low cards (2 through 7), and/or three of a kind, and/or a straight, and/or a flush, and/or a full house, which terms are well-known in the game of poker and which are used here in the same sense. In the embodiment shown in FIG. 1, the game board clearly shows that only for the two rows 11 and 17 of boxes, the players are clearly advised that "*Aces Are High And* 8 *Is House Card In HI-Lo Only.*"

At the lower part of the game board (or, alternatively in another form or embodiment, arranged in the center of the game board between rows 17 and 23), a box 37 larger than the above-described rows of boxes is provided for "Pat Hands." In this box are contained the instructions and odds for the cards of a hand which constitute "Pat Hands." For example, for pat hands an Ace may be considered a "1." According to a present preferred embodiment of the game, prior to the beginning of the game, a player who desires to guess on the value of a "pat hand" in box 37 must specify on his or her slip whether, if the hand is a "pat hand," the hand will be any 8 or under, or any 7-6 or under, or any 7-5 or under, and so on. As will be readily appreciated, the odds for making a correct guess of any 8 or under will be less than a correct guess for any 7-6 or under and so on. A player who guesses that the cards "dealt" in the hand when displayed on the board 10 at game's end will comprise a 5, 4, 3, 2, and an Ace (also known as a "wheel"), does so on the basis of the displayed odds which are the highest odds in view of the probabilities against such a hand being dealt.

By way of illustration only, the game board 10 can be about three feet high by about four feet wide and the box in each row of boxes can be about 3 inches by 3 inches. However, it should be clearly understood that these dimensions can be varied without departing from the present invention. The board also contains on the right-hand margin, a portion 38 which can be lit up to show when the game is "closed," i.e., is not in play. The left-hand margin 39 of the game board, on the other hand, contains a conventional means to sequentially light up the particular number of the game being played for control purposes. Each person who participates in this game will receive a slip 45, as shown in FIG. 2, bearing basically the same pattern shown on the game board surface 10 described above. For said control purposes, the slip may be previously or subsequently marked with the game number which must correspond to the results of the game number shown on the board. Likewise, although not absolutely critical, the basic pattern of the rows of boxes on the game board surface 10 can also be produced on a keyboard panel 46 of the Keno-type "goose" so that as the balls representing the cards are blown into the "rabbit ears," the machine operator can punch the appropriate button for the box in the panel 46 which is electrically connected in a conventional manner or electronically relayed over a telephone type cord to the game board 10 using, for example, rear screen projection for displaying the five cards selected and lamps to light up the appropriate boxes on the game board.

Prior to the game, each participant marks one or more slips with the desired guesses. The player need mark only one box or as many boxes as are desired, even if the guesses are inconsistent, with the exception of box 37 for "Pat Hands" where the player must specify the pat hand value or under. After the slips are collected, the machine operator activates the machine for shuffling or mixing the balls and thereafter blowing five of these balls into the rabbit ears corresponding to numerals 1 through 5 on the game board. As each of the five balls is blown, or alternatively after all of the five balls are blown, the cards are pictorially displayed in the box 47 beneath each of the numerals 1 through 5 in the order in which the balls were blown into the "rabbit ears." Depending upon the hand "dealt", the machine operator will by means of panel 46 activate and illuminate one or more of the appropriate boxes in rows 11, 17, 23, 30, and 37. Any player who has correctly guessed on the slip or slips with respect to one or more of the appropriate boxes is considered a winner and receives a number of chips or the like commensurate with the particular game odds.

Figure 3:
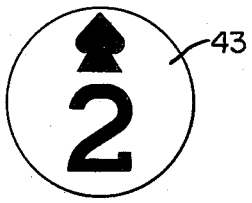
FIG. 3 shows one of the balls representing the two of Spades.
Figure 4:
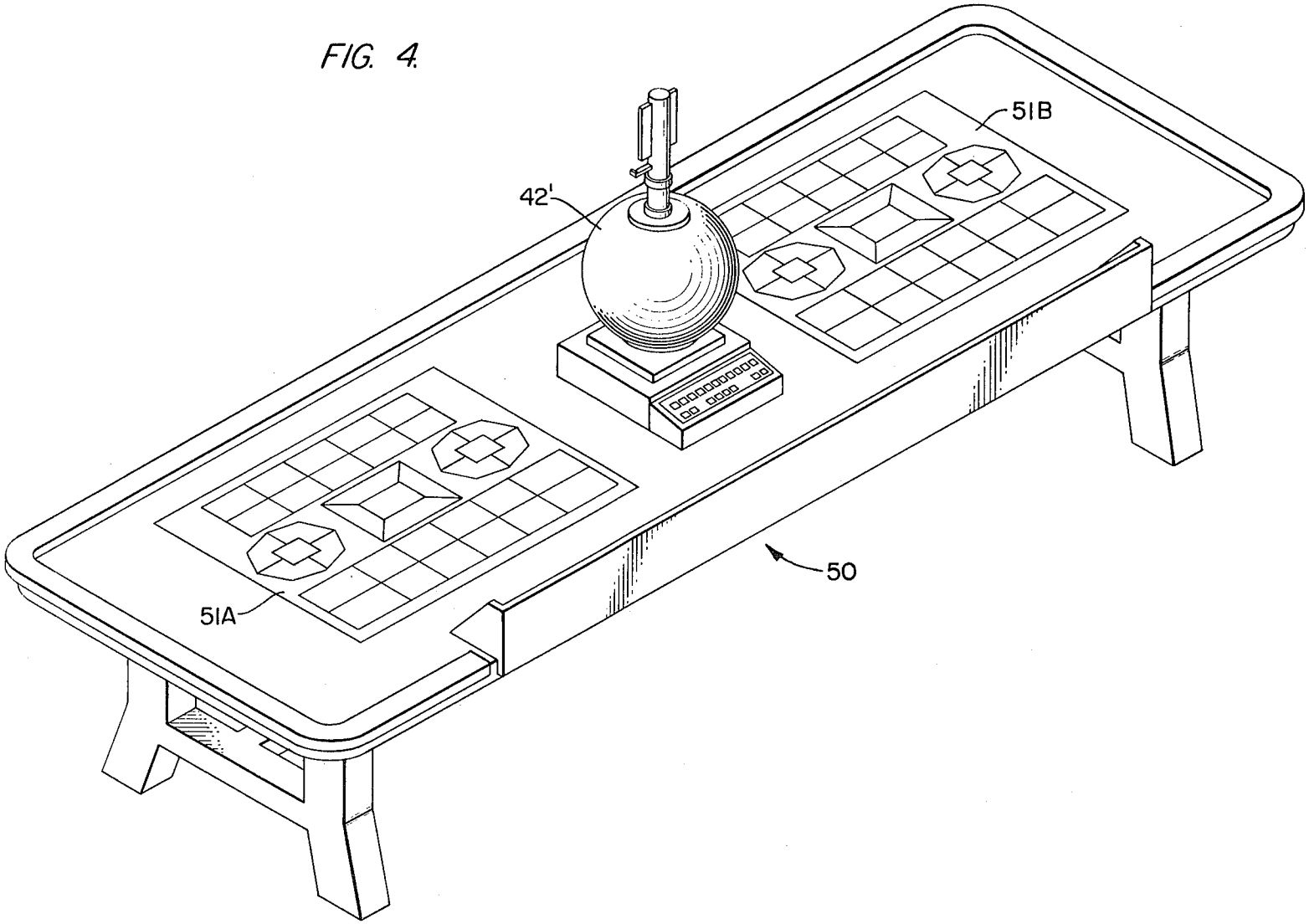
FIG. 4 shows a further embodiment of the novel game wherein a game table is used and, instead of slips, chips or the like are placed directly on the game table surface.
Figure 5:
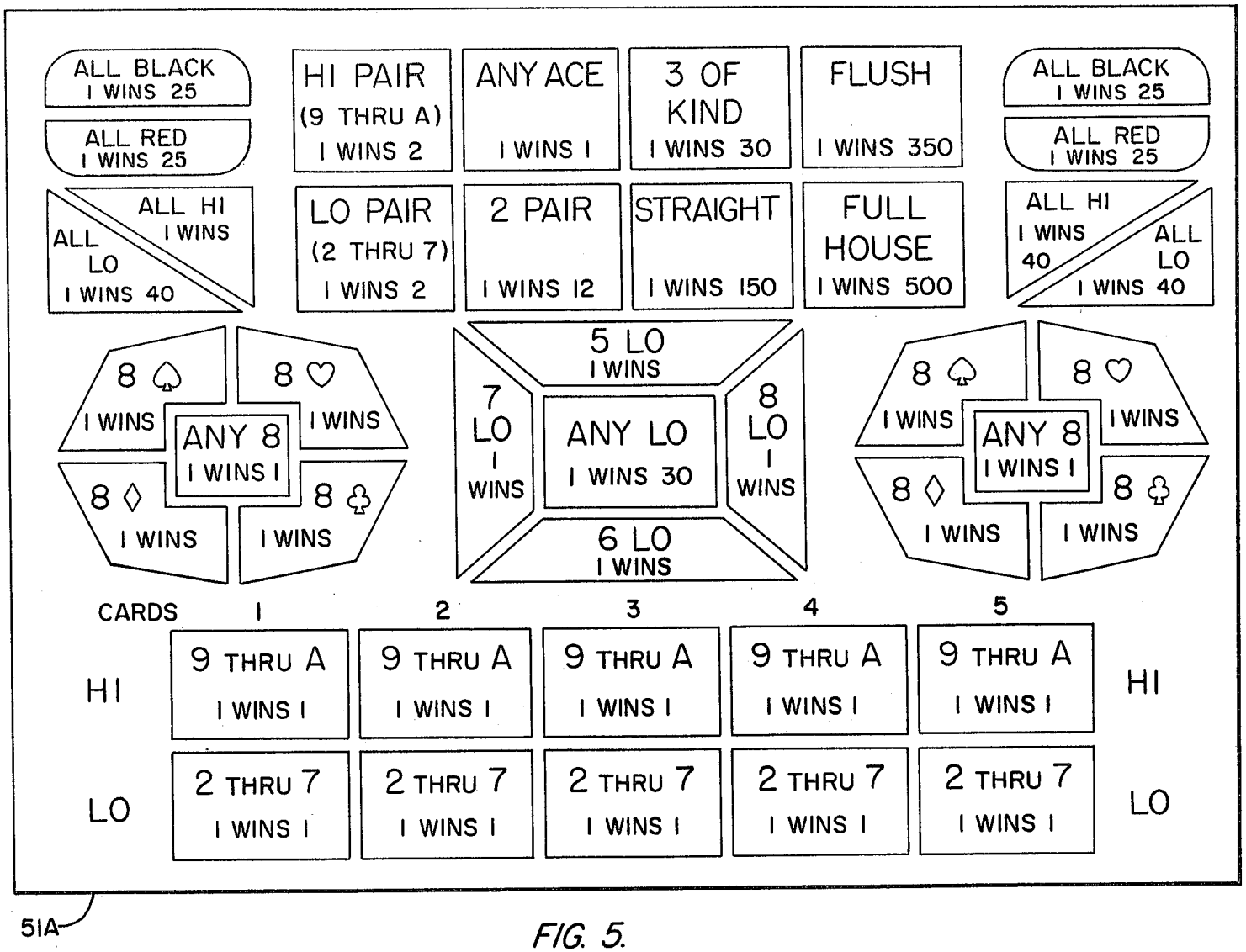
FIG. 5 is a plan view of one of the game surfaces on the table shown in FIG. 4.

The embodiments shown in FIGS. 4 and 5 is played in the manner described above in connection with the embodiment shown in FIGS. 1 through 3. However, instead of using a surface 10 which is hung in a room and slips, the "goose" 42' can be located on a game table designated generally by the numeral 50 having one or more game surfaces thereon. In the embodiment shown in FIG. 4, the game table 50 has two identical surface 51A, 51B upon which the results of a particular poker hand are displayed. Players can thus play upon either surface, such as the one shown in FIG. 5, and make their guesses by placing chips or the like in the particular area on the table surface in which the player is attempting to guess whether the card or cards in a particular poker hand selected by operation of the "goose" will have a certain value or will have a certain combination of values or will be of a certain suit or the like. The dealer blows the balls into the "rabbit ear" and then presses the appropriate display buttons, via conventional electronic means, to display the results, including combinations, upon the surface 51A, 51B so that winning guesses can be quickly ascertained.

While I have shown and described several embodiments of my invention, it is to be clearly understood that the same is susceptible of numerous changes and modifications without departing from the scope of the invention. For example, the particular odds shown in the drawings may be varied. Therefore, I do not wish to be limited to the details shown and described herein but intend to cover all such modifications as are encompassed by the scope of the appended claims.

I claim:

1. A game playable by one or more persons, comprising at least one game board usable by the one or more persons simultaneously having means associated with the surface thereof for designating a plurality of positions corresponding to combinations and values as occur in the card game of poker; and means associated with said at least one game board for selecting a number of balls corresponding to the number of cards dealt in a poker hand from a group of balls representing each of the cards in a conventional deck of playing cards used for the game of poker and displaying the results of the balls selected at one or more of the positions on the surface of said at least one game board.

2. A game as set forth in claim 1, wherein the position-designating means including positions at which representations of cards corresponding to the selected balls are displayed on the surface of said at least one game board.

3. A game as set forth in claim 2, wherein the position at which the card representations are displayed are marked consecutively as "1," "2," "3," "4," and "5."

4. A game as set forth in claim 2, wherein the position-designating means include a first series of defined areas arranged in a row aligned with and corresponding to each card representation and actuatable to notify each player if the card aligned with that area has a value of "9," "10," Jack, Queen, King, or Ace.

5. A game as set forth in claim 4, wherein the position-designating means include a second series of defined areas arranged in a row aligned with and corresponding to each card representation and actuatable to notify each player if the card aligned with that area has a value of "2," "3," "4," "5," "6," or "7."

6. A game as set forth in claim 5, wherein the first series of defined areas is designated as the "HI" row and the second series of defined areas is designated as the "Lo" row.

7. A game as set forth in claim 5, wherein the position-designating means include a third series of defined areas being selectively actuatable to notify each player if the poker hand consists of all red cards, all high cards, all face cards, a pair of "6"s or better, a pat "7" or better, and two pairs.

8. A game as set forth in claim 7, wherein the position-designating means include a fourth series of defined areas being selectively actuatable to notify each player if the poker hand consists of all black cards, all low cards, three of a kind, a straight, a flush, and a full house.

9. A game as set forth in claim 8, wherein the position-designating means include a defined area being selectively actuatable for notifying each player if the card of highest value in the poker hand dealt by the balls selected from the group of balls is no higher than "8" with the hand containing no pairs.

10. A game as set forth in claim 1, wherein the position-designating means has associated therewith the odds against which each player is guessing for a particular combination in a poker hand and/or for a particular value of one or more cards in the poker hand.

11. A poker-keno game in which one or more players can guess that a poker hand randomly selected during a game will contain particular card combinations and/or particular values of one or more cards, comprising at least one game board, which is usable by one or more players for the game, having means associated therewith and being selectively actuatable for designating a plurality of positions corresponding to the card combinations and values in the poker hand; game slip means have said position-designating means associated therewith so that a player can make his guesses for particular combinations and/or particular values in the poker hand in each game; and means associated with said at least one game board for selecting a number of balls corresponding to the number of cards dealt in the poker hand from a group of balls representing each of the cards in a deck of playing cards used in the game of poker and for selectively actuating appropriate positions on said at least one game board corresponding to the combinations and card values in the poker hand.

12. A game based on the card game of poker but playable by one person or more than one person by guessing values of one or more cards in a poker hand and/or predetermined combinations of two or more cards as occur in a poker hand in varying probabilities, comprising at least one game display, which is to be used by the one person or the more than one persons during a game, having means associated therewith for designating on the surface a first plurality of positions corresponding to the value of each card in a poker hand and a second plurality of positions corresponding to predetermined combinations of two or more cards in a poker hand; means for randomly selecting a poker hand; and means for showing the value of each card in the randomly selected poker hand on said first plurality of positions and any predetermined combinations of two or more cards as occur in randomly selected poker hand on said second plurality of positions, whereby a player can guess values of one or more cards in the randomly selected poker hand and/or one or more predetermined combinations of two or more cards in the poker hand.

13. A game according to claim 12, wherein the first plurality of positions includes areas for notifying each player if one or more cards in the randomly selected poker hand have a value of "9," "10," Jack, Queen, King, or Ace.

14. A game according to claim 13, wherein the first plurality of positions include areas for notifying each player if one or more of the cards in the randomly selected poker hand have a value of "2," "3," "4," "5," "6," or "7."

15. A game according to claim 12, wherein the second plurality of positions include areas for notifying each player if the randomly selected poker hand consists of one or more predetermined combinations including all black cards, all red cards, all low cards, two pairs, three of a kind, a straight, and a flush.

16. A game according to claim 15, wherein the second plurality of positions also include an area for notifying each player if the card of highest value in the poker hand is no higher than "8" with the hand containing no pairs.

17. A game according to claim 12, wherein the first and second plurality of positions have associated therewith the odds against which each player is guessing.

18. A game according to claim 12, wherein a group of balls represent the cards used in a conventional deck of playing cards for the game of poker, and the means for randomly selecting a poker hand constitutes a device for randomly selecting a number of balls corresponding to the number of cards dealt in a poker hand.

19. A game according to claim 18, wherein the at least one game display includes means for showing representations of cards corresponding to the randomly selected balls.

20. A game according to claim 19, wherein that portion of the display showing the representations of cards corresponding to the randomly selected balls is marked consecutively as "1," "2," "3," "4," and "5."

21. A game according to claim 20, wherein the first plurality of positions include areas aligned with and corresponding to each card representation and actuatable for notifying each player, if one or more card representation has a value of "9," "10," Jack, Queen, King, or Ace, or if one or more card representations has a value of "2," "3," "4," "5," "6, " or "7."

22. A game according to claim 21, wherein the second plurality of positions include areas actuatable for notifying each player if the randomly selected card representations consist of one or more predetermined combinations of all black cards, all red cards, all high cards, all low cards, all face cards, a pair of "6"s or better, a pat "7" or better, two pairs, three of a kind, a straight, a flush, and a full house.

23. A game according to claim 22, wherein the second plurality of positions further include an area actuatable for notifying each player if the card representation of highest value in the hand is no higher than "8" with the hand containing no pairs.

24. A game according to claim 23, wherein the first and second plurality of positions have associated therewith the odds against which each player is guessing.

25. A game based on the card game of poker but playable by even one person by guessing the values of one or more cards in a poker hand and/or predetermined combinations of two or more cards as occur in poker hand in varying probabilities, comprising at least one game display, which can be used by one or more persons during the same game, having means associated therewith for designating the value of each card in a randomly selected poker hand and predetermined combinations of two or more cards in a poker hand; game slip means having means associated therewith corresponding to the designating means of said display so that a player can guess values of one or more cards in the poker hand and/or said predetermined combinations; Keno-type means for randomly selecting a poker hand including a group of balls representing the cards used in a conventional deck of playing cards for the game of poker and a device for randomly selecting a number of balls from said group corresponding to the number of cards dealt in a poker hand; and means for showing the value of each card representation on said first plurality of positions as well as any predetermined combinations of two or more cards as occur in each poker hand.

26. A game according to claim 25, wherein the at least one game display includes means for showing representations of cards corresponding to the randomly selected balls.

27. A game according to claim 26, wherein the first plurality of positions include areas aligned with and corresponding to each card representation and actuatable for notifying each player if one or more card representation has a value of "9," "10," Jack, Queen, King, and Ace, or if one or more card representations has a value of "2," "3," "4," "5," "6," and "7."

28. A game according to claim 27, wherein the second plurality of positions include areas actuatable for notifying each player the randomly selected card representations consist of one or more predetermined combinations of all black cards, all red cards, all high cards, all low cards, all face cards, a pair of "6"s or better, a pat "7" or better, two pairs, three of a kind, a straight, a flush, and a full house.

29. A game according to claim 28, wherein the second plurality of positions further include an area actuatable for notifying each player if the card representation of highest value in the hand is no higher than "8" with the hand containing no pairs.

30. A game according to claim 29, wherein the first and second plurality of positions have associated therewith the odds against which each player is guessing.

* * * * *